US010981050B2

(12) United States Patent
Shin

(10) Patent No.: US 10,981,050 B2
(45) Date of Patent: Apr. 20, 2021

(54) SMART MAGIC CUBE AND OPERATION METHOD THEREOF

(71) Applicant: Smartcubelabs, Gunpo-si (KR)

(72) Inventor: Bong Gu Shin, Incheon (KR)

(73) Assignee: SMARTCUBELABS, Gunpo-si (KR)

( * ) Notice: Subject to any disclaimer, the term of this patent is extended or adjusted under 35 U.S.C. 154(b) by 238 days.

(21) Appl. No.: 15/956,062

(22) Filed: Apr. 18, 2018

(65) Prior Publication Data

US 2018/0311566 A1 Nov. 1, 2018

(30) Foreign Application Priority Data

Apr. 28, 2017 (KR) ..... 10-2017-0055137

(51) Int. Cl.

*A63F 9/08* (2006.01)
*A63F 9/24* (2006.01)
*A63F 9/06* (2006.01)

(52) U.S. Cl.

CPC ..... *A63F 9/0838* (2013.01); *A63F 9/0612* (2013.01); *A63F 9/24* (2013.01);
(Continued)

(58) Field of Classification Search

CPC .. A63F 9/08; A63F 9/0826; A63F 9/06; A63F 9/0811; A63F 9/0838; A63F 9/0842; A63F 2009/0846

See application file for complete search history.

(56) References Cited

U.S. PATENT DOCUMENTS 8,465,020 B2 * 6/2013 Dai ..... A63F 9/0842 273/153 R
10,773,152 B2 9/2020 Su et al.
(Continued)

FOREIGN PATENT DOCUMENTS

CN 101766907 A 7/2010
CN 102728052 A 10/2012
(Continued)

OTHER PUBLICATIONS

Rubik's Futuro Cube 2.0, posted Nov. 29, 2015, https://www.youtube.com/watch?v=x-cYWoTjlsQ (Year: 2015).*
(Continued)

*Primary Examiner* — Omkar A Deodhar
*Assistant Examiner* — Ross A Williams
(74) *Attorney, Agent, or Firm* — Paratus Law Group, PLLC

(57) ABSTRACT

The present invention relates to a smart magic cube providing a cube game by changing lights of respective cells constituting a magic cube while the cells are fixed, and an operation method thereof. A smart magic cube of the present invention includes: a cube housing in which each surface is divided by N×N cells; a light emitting part formed inside each cell and emitting at least one type of light externally through a surface of the cell; six rotation means formed in a rotatable manner; a rotation sensing part sensing a rotation direction and a rotation angle of the rotation means; and a control part controlling the light emitting part to change and emit lights such that border cells of a surface where the rotated rotation means is formed, and cells of four different surfaces adjacent to the border cells output lights changed according to a preset rule.

41 Claims, 10 Drawing Sheets

(52) U.S. Cl.
CPC ..... *A63F 2009/2442* (2013.01); *A63F 2009/2454* (2013.01); *A63F 2009/2482* (2013.01)

(56) References Cited

U.S. PATENT DOCUMENTS

| | | | | |
|---|---|---|---|---|
| 2008/0237981 | A1* | 10/2008 | Gilles | A63F 9/0613 273/153 S |
| 2010/0261514 | A1* | 10/2010 | Gramelspacher | A63F 13/428 463/9 |
| 2012/0302303 | A1* | 11/2012 | Rosendo | A63F 9/0842 463/9 |
| 2014/0265116 | A1* | 9/2014 | Christianson | A63F 9/0842 273/153 S |

FOREIGN PATENT DOCUMENTS

| | | | |
|---|---|---|---|
| CN | 105641919 | A | 6/2016 |
| CN | 106110651 | A | 11/2016 |
| KR | 10-2008-0083569 | A | 9/2008 |

OTHER PUBLICATIONS

RedKB, "Rubik's Touch Cube Review", https://www.youtube.com/watch?v=I-TWH5W-1fw, Nov. 28, 2009.
Chinese Office Action for related CN Application No. 201810402805.7 dated Feb. 3, 2021 from Chinese Intellectual Property Office.

* cited by examiner

SMART MAGIC CUBE AND OPERATION METHOD THEREOF

CROSS REFERENCE TO RELATED APPLICATION

The present application claims priority to Korean Patent Application No. 10-2017-0055137, filed Apr. 28, 2017, the entire contents of which is incorporated herein for all purposes by this reference.

BACKGROUND OF THE INVENTION

Field of the Invention

The present invention relates generally to a magic cube. Particularly, the present invention relates to a smart magic cube that provides a cube game by changing, by a light emitting part, lights of respective cells constituting a magic cube while the cells are fixed, and to an operation method thereof.

Description of the Related Art

Generally, a magic cube is a kind of puzzle game, and one such example is called a Rubik's cube. As an example shown in FIG. 1, the magic cube has a form of a large cube constituted of a plurality of small cubes which are formed to move in various directions. The objective of the magic cube game is to arrange each surface thereof to have the same color from the plurality of small cubes. The above game is called a magic cube game, and the magic cube game means to make the color of the visible surface to be the same.

As shown in FIG. 1, a magic cube is configured with N×N cube cells on each surface thereof. A 3×3 type is typical, but there are also 2×2, 4×4, 5×5, 7×7, etc. Recently, a 3×3×3 magic cube has become so popular that a world championship magic cube competition is held. The magic cube is also widely used for children's education.

However, when playing a conventional magic cube, someone who mixes the colors by turning the cube is required to create a game whenever a cube game is provided. In addition, devices for measuring a time required for completing a cube game are required in a cube game contest or match so that cost for the same increases.

In addition, when playing a conventional magic cube, it is difficult to share cube game records among various users, and it is impossible to play a cube game under the same cube game condition between users far away, thus it is difficult to secure reliability of the cube game record between users.

Meanwhile, recently, there is provided a magic cube in which respective cells output colors by installing a light emitting device inside each cell of a magic cube, and a user changes cell colors by touching the same rather than directly turning the cell. By sensing a touch direction of the user by using a sensor, the light emitting device is controlled to change in color so that the user may play the magic cube game without directly turning the cell by his or her hand.

However, since a user does not turn the magic cube by hand, it is difficult for a person familiar with the conventional magic cube to adapt, and there is a limit to provide pleasure given by manual manipulation of the magic game. In addition, it may be more difficult to solve the magic cube since the user does not play the magic cube by actually turning the cubes while feeling his or her sense of hand.

The foregoing is intended merely to aid in the understanding of the background of the present invention, and is not intended to mean that the present invention falls within the purview of the related art that is already known to those skilled in the art.

Documents of Related Art (Patent Document 1) Korea Patent Application Publication No. 10-2008-0083569;

(Patent Document 2) Chinese Patent Application Publication No. 101766907;

(non-Patent Document 1) Internet video: https://www.youtube.com/watch?v=l-TWH5W-1fw

SUMMARY OF THE INVENTION

Accordingly, the present invention has been made keeping in mind the above problems occurring in the related art, and the present invention is intended to provide a smart magic cube, wherein a user may play a cube game without moving cells constituting a magic cube by robotizing the magic cube, and an operation method thereof.

In addition, another object of the present invention is to provide a smart magic cube being capable of, whenever a cube game is provided, providing a cube game by mixing lights according to a program stored inside the smart magic cube, and measuring a time elapsed for completing the cube game.

In addition, still another object of the present invention is to provide a smart magic cube being capable of sharing cube game records among various users, and securing reliability for the cube game records, and an operation method thereof.

In addition, still further another object of the present invention is to provide a smart magic cube being capable of rotating a rotation means and controlling light changes in each surface by providing a rotatable rotation means in each surface of the magic cube so that an effect of directly turning the magic cube by hand is provided, and an operation method thereof.

In addition, still further another object of the present invention is to provide a smart magic cube capable of downloading from an external device various kind of information such as various cube game patterns, a method of playing various cube games, records, etc. by performing wired/wireless communication with the external device, and alternatively, of transmitting various types of internal information to the external device, and an operation method thereof.

A smart magic cube according to an embodiment of the present invention includes: a cube housing in which each surface is divided by N×N cells; a light emitting part formed inside each cell and emitting at least one type of light externally through a surface of the cell; six rotation means formed in a rotatable manner based on a rotation shaft passing through a center of each surface; a rotation sensing part sensing a rotation direction and a rotation angle according to a rotation of each of the six rotation means; and a control part controlling the light emitting part to change and emit lights such that border cells of a surface where the rotated rotation means is formed, and cells of four different surfaces adjacent to the border cells output lights changed according to a preset rule in response to the rotation direction and the rotation angle of the rotation means sensed by the rotation sensing part.

In addition, a smart magic cube according to another embodiment of the present invention includes: a body part formed having an internal space at a center thereof, and a through hole formed to a direction of each cube surface at the internal space thereof; N×N cells coupled with respective through holes at an end part thereof; a light emitting part formed inside of each cell, and emitting various types of lights externally through a surface of each cell; six rotation means formed in a rotatable manner by being coupled with a rotation shaft passing through a center of each surface; a rotation sensing part formed in each through hole, and sensing a rotation direction and a rotation angle according to the rotation of each of the six rotation means; and a control part controlling the light emitting part to change and emit lights such that border cells of a surface wherein the rotated rotation means is formed, and cells of four different surfaces adjacent to the border cells output lights changed according to a preset rule in response to the rotation direction and the rotation angle of the rotation means sensed by the rotation sensing part.

In addition, a method of operating a smart magic cube according to an embodiment of the present invention includes: sensing, by a rotation sensing part, a rotation direction and a rotation angle of a rotation means; and changing and outputting lights of border cells of a surface where a rotated rotation means is formed, and lights of cells colors of cells of four different surfaces adjacent to the border cells changed according to a preset rule in response to the rotation direction and the rotation angle of the rotation means are sensed by the rotation sensing part.

In addition, a method of operating a smart magic cube according to another embodiment of the present invention includes: starting counting, by a counting part, an operation time when a rotation sensing part starts sensing a rotation direction and a rotation angle; changing and outputting lights of border cells of a surface where the rotated rotation means is formed, and lights of cells of four different surfaces adjacent to the border cells changed according to a preset rule in response to the rotation direction and the rotation angle of the rotation means sensed by the rotation sensing part; stopping counting the operation time at a time when cells between surfaces output lights different from each other, and N×N cells of the same surface output the same lights according to the rotation of the rotation means; and storing an operation record from the starting to the stopping of counting the operation time in an internal memory.

In addition, a method of operating a smart magic cube according to another embodiment of the present invention includes: when a first mode is set, changing cell lights of each cube surface according to at least one color pattern among a plurality of preset color patterns by mixing the cell lights; notifying stating of the first mode when a preset time elapses after setting the first mode; turning OFF lights of all cells of each surface when the first mode is started; start counting, by a counting part, an operation time when a rotation sensing part starts sensing a rotation direction and a rotation angle of a rotation means after turning OFF the lights; sequentially storing in an internal memory the rotation direction and the rotation angle of the rotation means sensed by the rotation sensing part in response to the rotation of the rotation means; stopping counting the operation time at a time when cells between surfaces output colors different from each other, and N×N cells of the same surface output the same color by the rotation direction and the rotation angle sequentially stored in the internal memory; storing an operation record from staring to stopping of counting the operation time; and notifying an end of the first mode.

In addition, a method of operating a smart magic cube according to another embodiment of the present invention includes: accessing, by the smart magic cube an external device; and downloading a cube game pattern from the accessed external device, and storing the downloaded cube game pattern in an internal memory, wherein in the cube game pattern, rotation information including a rotation order, an identifier (ID), a rotation direction, a rotation angle, a rotation speed, and a rotation time of a rotation means or at least one piece of information is set as one set.

The present invention has the following effects.

A cube game can be rapidly provided by mixing lights of each surface according to a game pattern of a magic cube by robotizing the magic cube of the present invention rather than requiring a user to mix cube colors.

In addition, motivations to improve his or her skills may be increased by automatically measuring a record time of a magic cube of the present invention, determining a rank thereof, and sharing the same among users.

In addition, a user can further enhance his or her ability by replaying, by a robotized smart magic cube, his or her cube game and analyzing the way how he or she has solved the cube game, and his or her imagination and intelligence development can be improved by stimulating his or her imagination by coding the cube game.

In addition, the magic cube can be networked and the same game pattern can be simultaneously played by people all over the world so that exciting games with fairness secured can be induced.

In addition, by robotizing the magic cube, intelligence and creativity development can be conducted by making the same in networked games so that Internet of Robots, beyond the Internet of Things, can be implemented

BRIEF DESCRIPTION OF THE DRAWINGS

The above and other objects, features and other advantages of the present invention will be more clearly understood from the following detailed description when taken in conjunction with the accompanying drawings, in which.

DETAILED DESCRIPTION OF THE INVENTION

Figure 1:
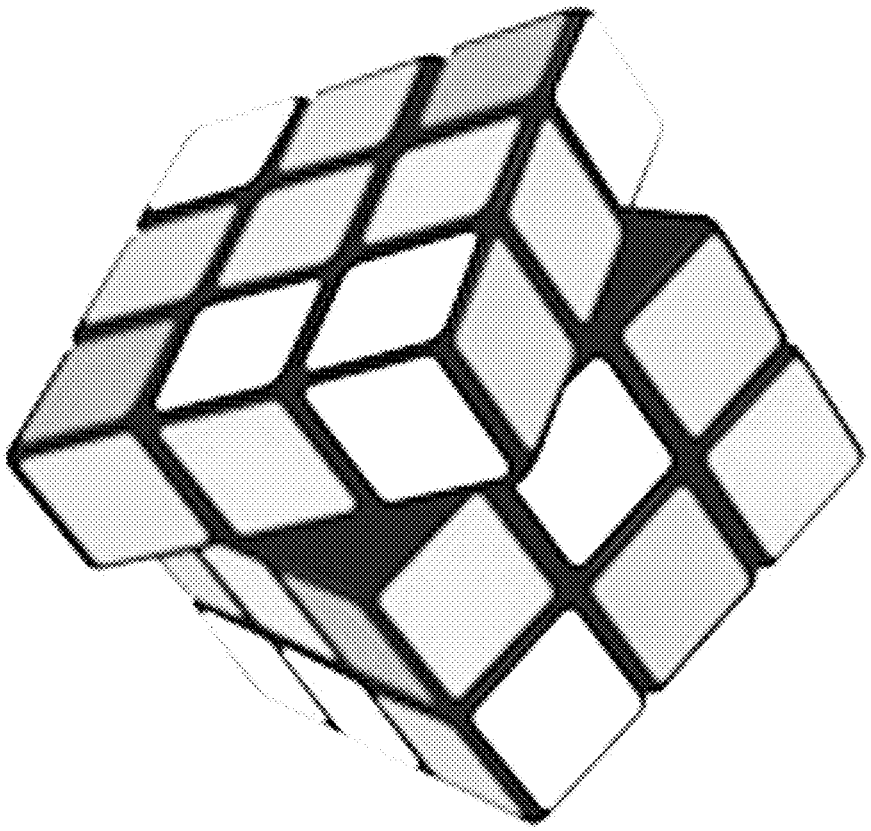
FIG. 1 is a view showing a perspective view of a conventional magic cube.

Hereinafter, exemplary embodiments of the present invention will be described in detail with reference to accompanying drawings. In assigning reference numerals to elements in each drawing, it shall be noted that like elements have like reference numerals as much as possible even if illustrated in different drawings. In describing the present invention, a detailed description of relevant known configurations or functions will be omitted if it is determined that such descriptions may make the substance of the present invention unclear.

In addition, in describing elements of the present invention, terms such as first, second A, B, (a), (b) and others may be used. Such terms are used only for purposes of distinguishing an element from other element, but do not limit the substance of the element, sequence or order. If it is stated that a certain element is "connected" or "coupled" to or "contacts" with another element, it should be understood that the certain element may be directly connected or coupled to the another element, but also another element may be "connected" or "coupled" to or "contacts" with such elements.

Figure 2:
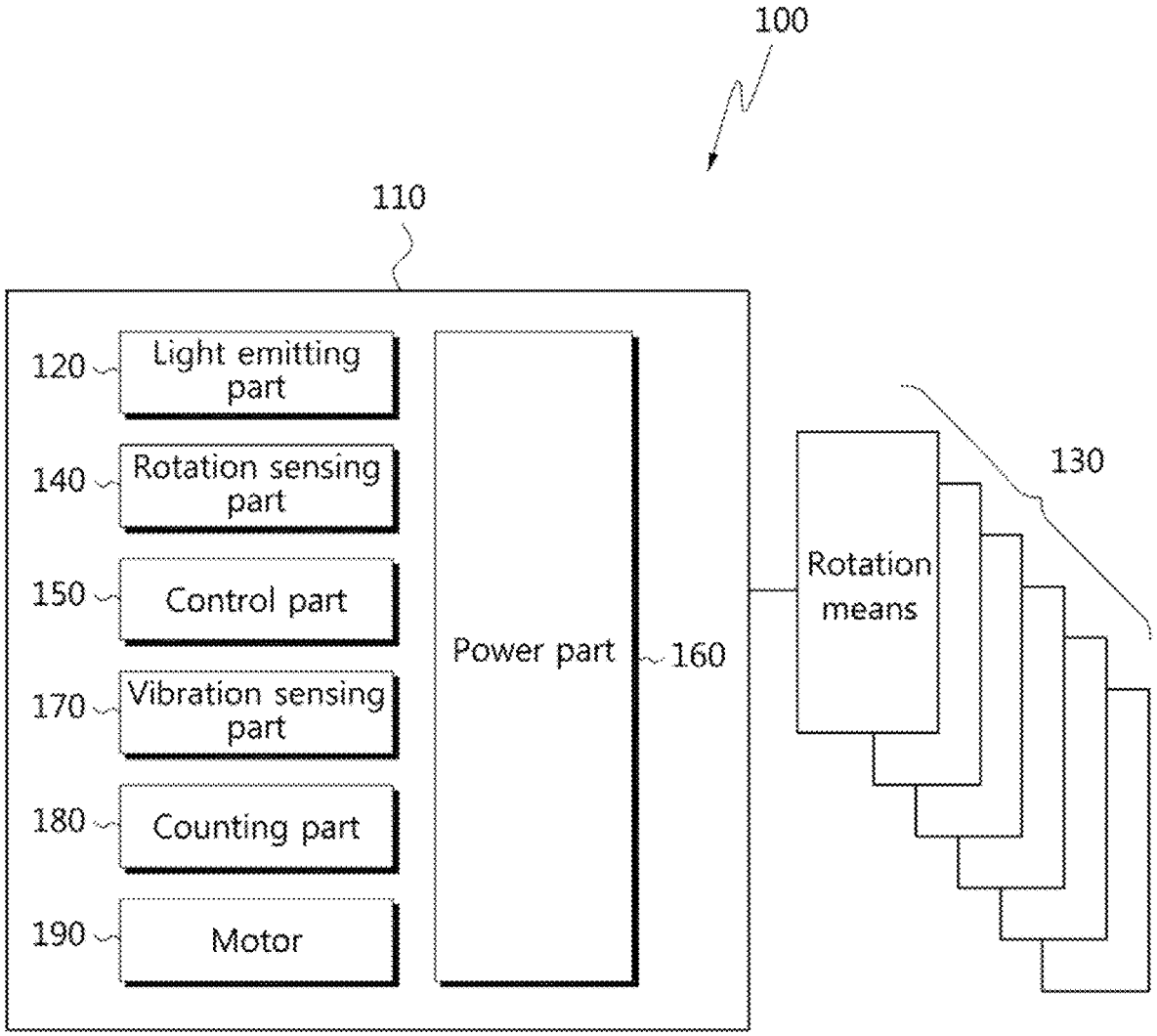
FIG. 2 is a view showing a configuration block diagram of a smart magic cube according to an embodiment of the present invention.
Figure 3:
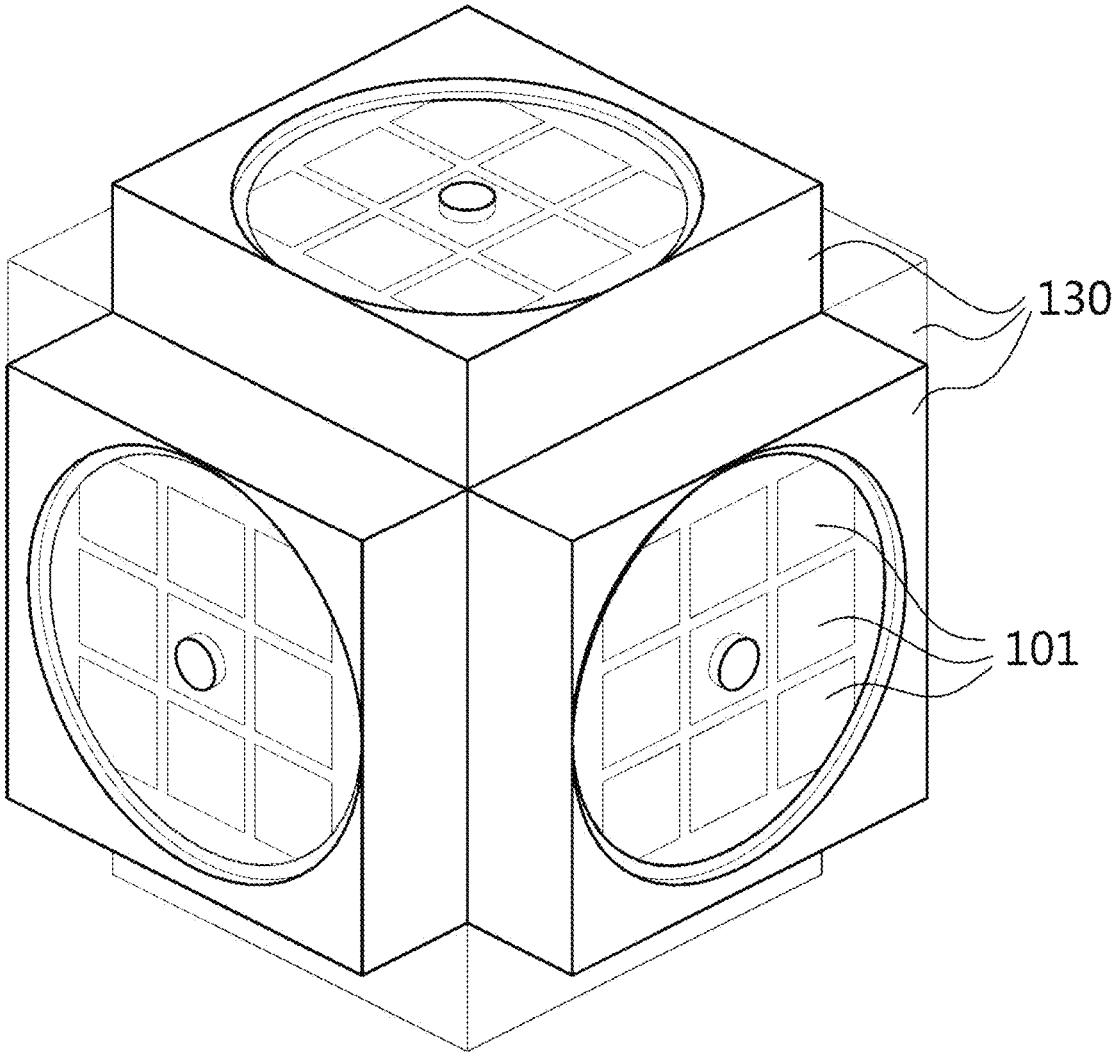
FIG. 3 is a view showing an external perspective view of the smart magic cube according to an embodiment of the present invention.

FIG. 2 is a view showing a configuration block diagram of a smart magic cube according to an embodiment of the present invention, and FIG. 3 is a view showing an external perspective view of the smart magic cube according to an embodiment of the present invention.

Referring to figures, a smart magic cube 100 according to an embodiment of the present invention is configured to include a cube housing 110, a light emitting part 120, a rotation means 130, a rotation sensing part 140, a control part 150, and a power part 160. In another embodiment, the smart magic cube 100 may further selectively include a vibration sensing part 170, a counting part 180, or a motor 190.

The housing 110 is formed in a shape of a cube, and each of six surfaces thereof is divided by N×N cells 101 having an identical size and shape. Herein, varying from a conventional magic cube, cells 101 and a block formed with cells of each surface are not formed in a rotatable manner, and each surface is divided by fixed cells 101.

The light emitting part 120 is formed inside of each cell 101, and externally emits at least one type of light by passing through the cell 101. It is preferable for each surface of the housing 110 being formed of transparent or semitransparent material to externally emit light by passing through the cell 101. The light emitting part 120 emits lights with various types and shapes. For example, the light emitting part 120 may emit lights with various colors, letters or figures, symbols, commercial characters, etc. Hereinafter, throughout embodiments, emitting or changing light means displaying or various colors, letters, figures, symbols, commercial characters by changing and emitting lights. Hereinafter, for convenience of description, for example, emitting light means emitting light with colors.

When emitting lights with colors, a plurality of LED devices may be included to emit lights with various colors, and light with a desired color may be output by combining a plurality of LED devices having a single color. Preferably, desired-color light is emitted by using and properly combining LED devices of red (R), blue (B), and green (G) colors. Herein, in the present embodiment, each cell 101 may independently emit light.

The rotation means 130 is formed in each of six surfaces constituting the cube housing 110. Preferably, each of the rotation means 130 is installed and fixed in a rotation shaft 131 that passes through the center of each surface of the cube, and is formed to rotate in left/right directions based on the rotation shaft 131. The six rotation means 130 rotate based on the rotation shaft 131 when a user rotates the rotation means 130 by his or her hand.

The rotation sensing part 140 senses a rotation direction and a rotation angle associated with the rotation of each rotation means 130. The rotation sensing part 140 may be implemented in a single module, and independently sense each rotation direction and rotation angle of the six rotation means 130. However, the rotation sensing part 140 may be installed in each of six rotation means 130, and sense each rotation direction and rotation angle of each rotation means 130. In detail, the rotation sensing part 140 is configured to sense a rotation direction and a rotation angle of the rotation shaft 131 coupled with the rotation means 130. In addition, the rotation sensing part 140 may sense, in addition to the above rotation direction and the rotation angle, various types of information such as identifier (ID), rotation speed, rotation time, etc. of the rotating rotation means 130 (hereinafter, referred as rotation information).

In response to a rotation direction and a rotation angle of the rotation means 130 sensed by the rotation sensing part 140 as the rotation means 130 rotates, the control part 150 controls the light emitting part 120 to change and emit lights such that cells of four different surfaces which are adjacent to border cells of a surface where the rotated rotation means 130 is formed output lights according to a preset rule.

In addition, the control part 150 stores in an internal memory in a time sequence rotation information of the rotation means 130 sensed by rotation sensing part 140 according to the rotation of the rotation means, that is, information of an identifier (ID), a rotation direction, a rotation angle, a rotation speed, a rotation time, etc. of the rotation means. The above information may be used when a user actually wants to replay a cube game by rotating the rotation means 130.

In other words, when a specific user plays a specific cube game, and the user has rotated the rotation means once in a left direction at 09:05:15 with a 90 degrees angle in a 8 m/s, and four times in a right direction at 09:05:21 with 180 degrees angle in a 7 m/s, the rotation sensing part 140 senses rotation information for each rotation means 130, and the control part 150 receives and stores in the internal memory the rotation information according to an operation sequence. Accordingly, when replaying a cube game according to rotation information later, the cube game is replayed by using the rotation information stored in the internal memory.

The power part 160 turns ON/OFF the smart magic cube 100. Preferably, the power part 160 provides or shuts down or both power of a part or all of configuration elements constituting the smart magic cube 100 according to a control of the control part 150. Particularly, when the smart magic cube 100 enters an ON state from an OFF state by the power of the power part 160, the control part 150 controls the light emitting part 120 so that light types different from each other are output to respective surfaces of the cube housing 110, and identical types of lights are output from all cells 101 of the same surface. In other words, lights are output as the cube game is completed.

The vibration sensing part 170 senses vibration of the housing 110. When vibration is sensed for a preset time or more by the vibration sensing part 170, the control part 150 controls the light emitting part 120 so that cells of each surfaces changes to at least one light pattern among a plurality of preset light patterns is by mixing cell lights. This is because for providing a cube game by mixing lights of cells 101 in the smart magic cube 100 so that the cells 101 are changed to an arbitrary game pattern. Accordingly, a cube game is automatically provided rather than the user directly mixes cells to start a game.

The counting part 180 counts a time during which the user plays a magic cube. For example, in one embodiment, the counting part 180 counts an elapsing time from an initial rotation time when the rotation means 130 start rotating to a completion time when cells 101 output colors different from each other between surfaces of the cube housing 110, and all N×N cells 101 of the same surface output colors of the same color. This is because for counting a starting time and a completion time of a cube game, the counted time may be used for a cube game match or for measuring a personal record.

The motor 190 may rotate a rotation shaft of the rotation means 130 by providing a rotation power according to a control of the control part 150. A rotation shaft of the motor 190 and the rotation shaft of the rotation means 130 are coupled to be associated with each other. Accordingly, as the motor 190 operates so that the rotation shaft of the motor 190 rotates, the rotation shaft of the rotation means 130 may rotate. Herein, the rotation shaft of the motor 190 and the rotation shaft of the rotation means 130 are installed to be parallel to each other. For example, the two rotation shafts may be installed and coupled in a straight line to be associated with each other. As another example, parts of the two rotation shafts may be installed side by side to be associated with each other by using at least one gear part.

Referring to FIG. 3, the smart magic cube 100 according to the present invention is formed in a shape having an approximately cube housing 110. Each surface of the cube is divided by N×N cells 101 having the same size. Each cell 101 includes a light emitting part 120 therein, and the light emitting part 120 externally emits a desired type of light through the cell 101. The light emitting part 120 emits light according to a control of the control part 150.

In addition, a rotation means 130 is installed in each surface, and a rotation shaft 131 is formed in the center of the rotation means 130. The rotation shaft 131 is installed to internally pass through the rotation means 130 from the center thereof to the center part of each surface. The rotation means 130 is formed to rotate in left/right directions based on the rotation shaft 131.

When the rotation means 130 rotates, the rotation sensing part 140 senses preset rotation information including a rotation direction and a rotation angle of the rotation means 130. The control part 150 controls the light emitting part 120 according to the rotation direction and the rotation angle of the rotation means 130 of the rotation information so that each cell 101 outputs light according to a preset rule.

Figure 4A:
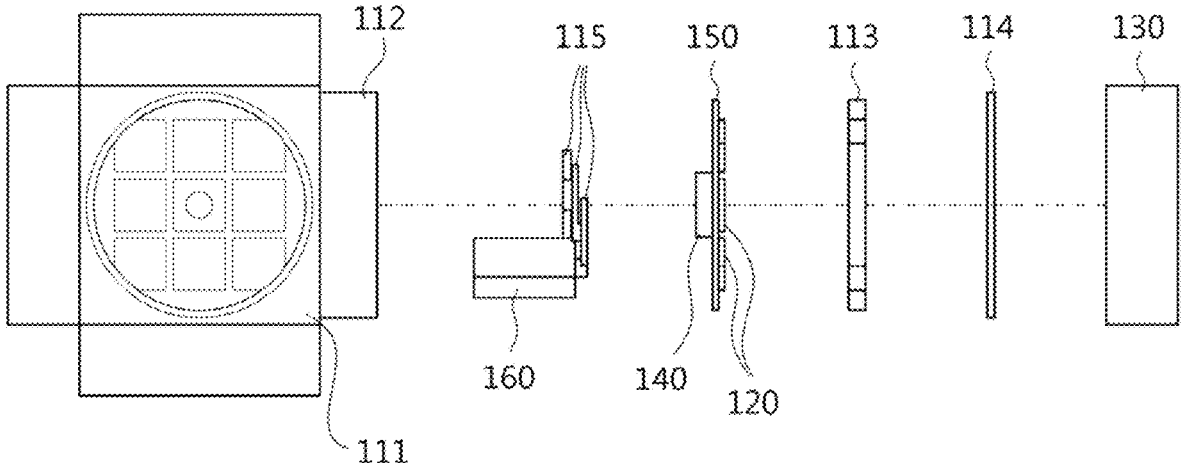
FIGS. 4A and 4B are views showing deployed views of one surface of the present invention smart magic cube according to an embodiment of the present invention.
Figure 4B:
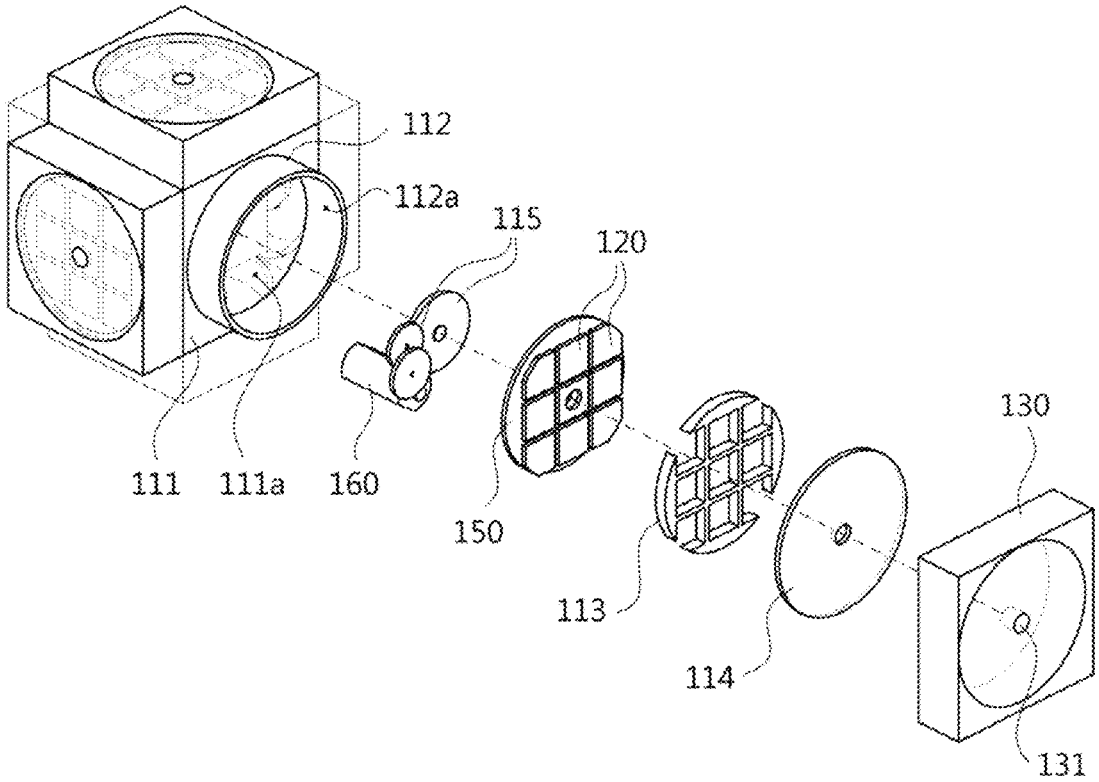

FIGS. 4A and 4B are views showing deployed views of one surface of the smart magic cube according to an embodiment of the present invention.

Referring to FIGS. 4A and 4B, the smart magic cube 100 according to the present invention includes a body 111 at the center part thereof. The body 111 is formed with a predetermined internal space 111*a* at the center part thereof, and a through hole 112 extending from the internal space 111*a* of the center part to a direction of the surface of the cube.

In the above configuration, each through hole 112 is coupled with a board in which N×N cells 101 is formed at an end part thereof. In addition, the light emitting part 120 is positioned in each cell 101 so that at least one type of light is emitted to the outside through a surface of each cell 101. Accordingly, when viewed from the outside, it may be checked that a specific kind of lights is output from each cell 101.

The rotation means 130 is coupled with the rotation shaft 131 passing through the center part of each surface, and is formed to rotate in left/right directions based on the rotation shaft 131. In addition, the rotation sensing part 140 is installed inside of each through hole 112, and senses a rotation direction and a rotation angle of each rotation means 130 according to the rotation thereof.

The control part 150 is installed in the interior of the light emitting part 120. In response to the rotation direction and the rotation angle of the rotation means 130 sensed by the rotation sensing part 140, the control part 150 controls the light emitting part 120 to change and emit lights such that cells of four different surfaces which are adjacent to border cells of a surface where the rotation means 130 is installed output lights according to a preset rule.

Herein, as shown in the figure, the light emitting part 120 may be implemented, for example, by mounting a LED device on a PCB substrate or on a control board, and the LED device is mounted thereon to be associated with each cell 101. In addition, the control part 150 may be implemented as a micro-computer, etc. and may be mounted on a PCB substrate or a control board with the light emitting part 120. The light emitting part 120 and the control part 150 may be implemented in a single module by mounting them on a substrate or on a board together.

As shown in the figure, in another embodiment, a blocking part 113 for blocking light travelling aside so that lights emitted from N×N cells 101 of each surface do not interfere with light of another cell 101, and a diffusion means 114 diffusing light having passed the blocking part 113 may be further included. When viewed from the outside, it appears that light is output throughout the cell 101 by the above diffusion means 114.

In another example, the smart magic cube 100 may further include a motor 190 installed inside each through hole 112. A rotation shaft of the motor 190 and the rotation shaft 131 of the rotation means 130 are coupled to be associated with each other. Accordingly, as the motor 190 operates, the rotation shaft of the motor 190 rotates, and thus the rotation of the rotation shaft 131 of the rotation means 130 is controlled by the rotation of the rotation shaft. The motor 190 is operated according to a control of the control part 150.

The motor 190 operates for stopping rotating of the rotation means 130 at a preset specific angle when the rotation means 130 rotates. For example, whenever a rotation angle of the rotation means 130 sensed by the rotation sensing part 140 becomes an integer multiple of 90 degrees, the motor 190 rotates the rotation shaft 131 in a direction opposite to the rotation direction of the rotation means 130 so that the rotation means 130 stops rotating. This is for forcibly stopping the rotation of the rotation means 130 whenever the rotation angle becomes an integer multiple of 90 degrees when the user rotates the rotation means 130.

Alternatively, the motor 190 may be used for rotating the rotation shaft 131 of the rotation means 130. In other words, when the rotation sensing part 140 senses the rotation of the rotation means 130, the control part 150 may operate the motor 190 so that the rotation means 130 is rotated as a rotation shaft 115 of the motor 190 rotates in a rotation direction of the rotation means 130. Herein, when a rotation angle of the rotation means 130 becomes an integer multiple of 90 degrees, the control part 150 stops operating the motor 190.

Herein, the rotation shaft 115 of the motor 190 and the rotation shaft 131 of the rotation means 130 are coupled to be associated with each other. For example, the two rotation shafts may be coupled by being installed in a straight line. As another example, the two rotation shafts may be arranged to be parallel from each other so that are coupled to be associated with each other by using at least one gear part 115. For any type, operations of the rotation shaft of the motor 190 and the rotation shaft of the rotation means 130 are associated with each other.

Hereinafter, a process of changing light of each cell 101 according to the rotation of the rotation means 130 will be described in detail.

Figure 5A:
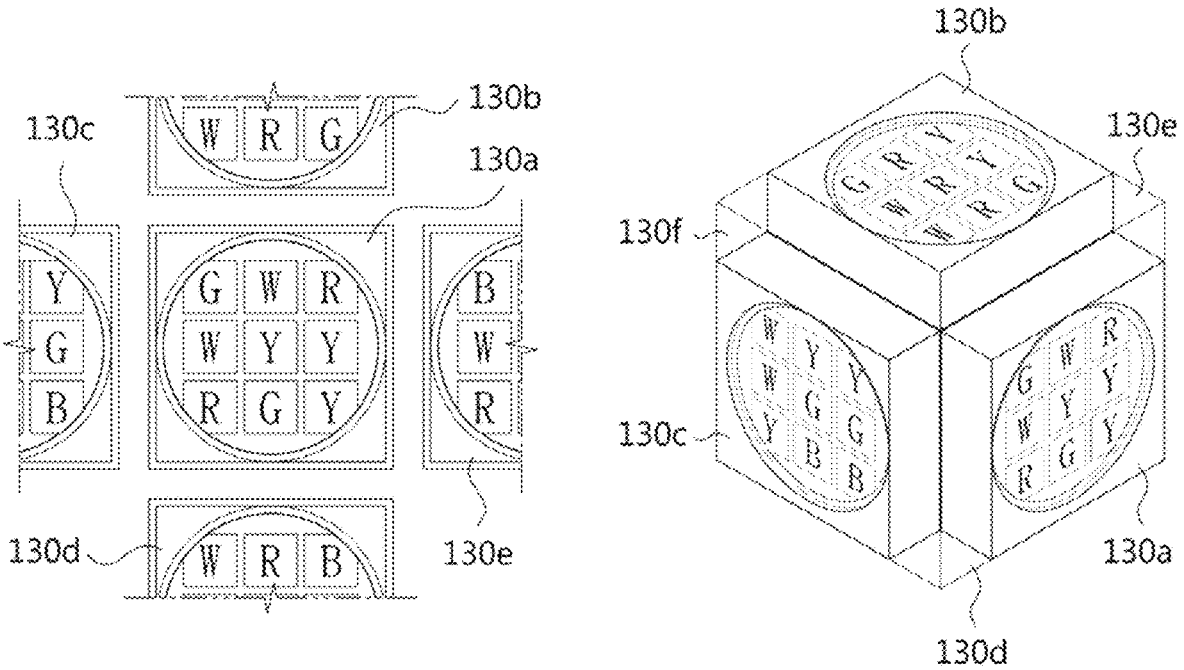
FIGS. 5A and 5B are views showing conceptual diagrams of showing a process of changing in colors of a cell according to a rotation of a rotation means in smart magic cube according to an embodiment of the present invention.
Figure 5B:
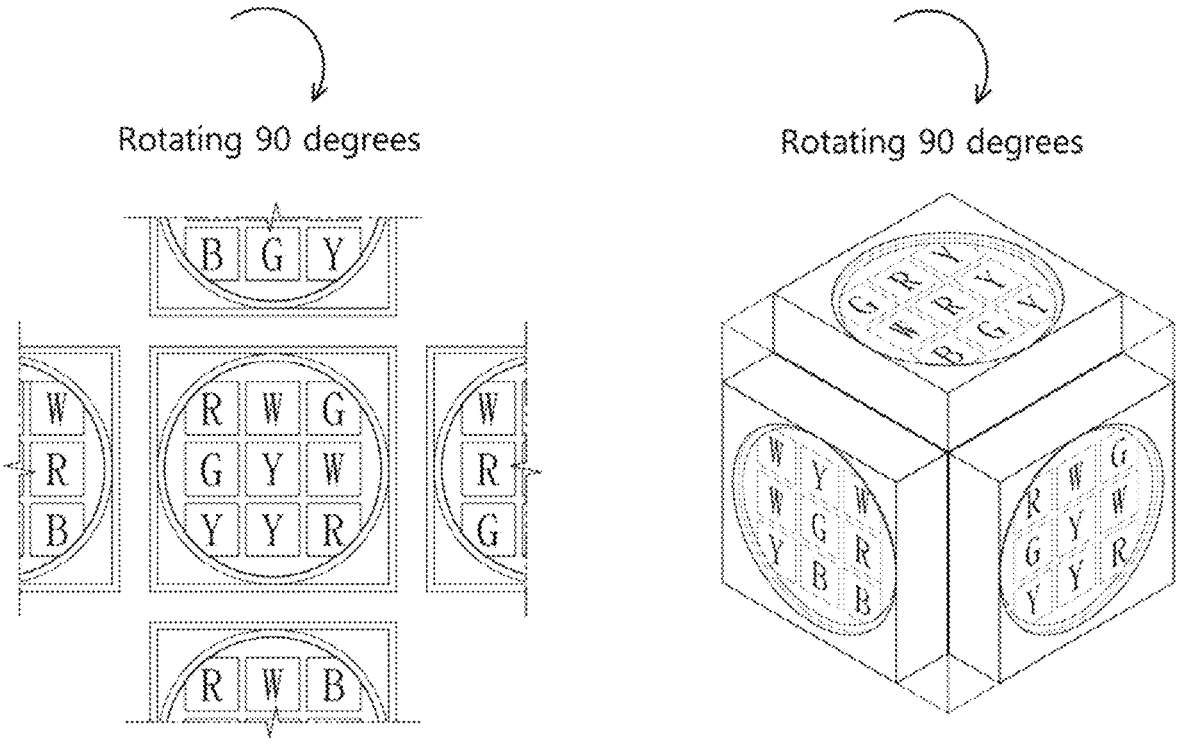

FIGS. 5A and 5B are views showing conceptual diagrams of showing a process of changing in colors of a cell according to a rotation of a rotation means in smart magic cube according to an embodiment of the present invention.

FIG. 5A is a view showing a case where a first rotation means 130*a* formed in a first surface of the cube housing 110 rotates in a right direction. For example, each surface is divided by 3×3 cells 101*a*.

For convenience of description, it is assumed that, in three cells of the first top horizontal line of the first surface, lights of green (G), white (W), and red (R) colors are respectively output, in three cells of the second middle horizontal line, lights of white (W), yellow (Y), and yellow (Y) colors are respectively output, and in three cells of the third bottom horizontal line, lights of red (R), green (G), and yellow (Y) colors are respectively output. The above assumption is an example, it may be implemented with lights of another color.

In addition, among four surfaces adjacent to the first surface, as shown in the figure, from a second surface that is an upper surface, a third surface that is a left surface, a fourth surface that is a low surface, and a fifth surface that is a right surface, as shown in the figure, lights with specific colors are output therefrom. Of course, although it is not shown, from a sixth surface that is a rear surface, lights of specific colors are output from respective cells.

Herein, as shown in FIG. 5B, when the first rotation means 130*a* formed in the first surface rotates to the right 90 degrees, a first rotation sensing part installed inside the housing 110 senses a rotation direction and a rotation angle of the first rotation means 130*a*. The sensed information is input to the control part 150.

When the first rotation means 130*a* rotates to the right 90 degrees as above, cells positioned at upper, low, left, and right borders among 3×3 cells 101*a* formed in the first surface where the first rotation means 130*a* is formed output lights as like the cells that move to the right 90 degrees.

Hereinafter, changing colors of respective cells of the first surface will be described in detail. As the first rotation means 130*a* is rotated to the right 90 degrees, three upper horizontal cells changes in color from G-W-R to R-W-G which are colors of three right vertical cells.

According to the above principle, three left vertical cells changes in color from Y-G-B to W-R-B which are colors of three bottom horizontal cells, three right vertical cells change in color from R-Y-Y to G-W-R which are colors of three upper horizontal cells, and three bottom horizontal cells change in color from R-G-Y to R-W-B which are colors of three right vertical cells. Herein, the cell 1015 positioned at the center does not changes in color.

Color changes in the cells 101*a* of the first surface makes a result of rotating to the right 90 degrees based on the central cell 1015. In the present invention, the cell does not physically move, and the cells change in color while positions thereof are fixed.

The rotation means 130 may rotate in left/right directions with an arbitrary angle. However, it is preferable to rotate with an angle of an integer multiple of 90 degrees to play a cube game. For example, when the first rotation means 130*a* rotates in a right direction 180 degrees in FIG. 5A, three upper horizontal cells of the first surface change in color from G-W-R to Y-G-R which are colors in an inverse order of R-G-Y which are colors of three bottom horizontal cells. The above principle is identically applied to an angle of an integer multiple of 90 degrees such as 270 degrees, 360 degrees, 450 degrees, etc.

In addition, in association with the changes in color of the cells in the first surface 116 as above, partial cells of a second surface to a fifth surface which are adjacent to the first surface change in color. In other words, as the first rotation means 1300 moves to the right 90 degrees as above, cells of the second surface to the fifth surface which are adjacent to upper, low, left, and right borders of the first surface change in color.

As shown in FIGS. 5A and 5B, among N×N cells 101*b* of a second surface positioned at the upper surface, 1×N cells adjacent to the upper border cell of the first surface change in color from W-R-G to B-G-Y which are colors of 1×N cells adjacent to the left border cells of the first surface among N×N cells of a third surface positioned at the left surface.

According to the above principle, among N×N cells 101*d* of a fourth surface, 1×N cells 101*c* of a third surface changes in color from Y-G-B to W-R-B which are colors of bottom border cells of the first surface, 1×N cells 101*d* of the fourth surface change in color from W-R-B to R-W-B which are colors of right border cells of the first surface among N×N cells of a fifth surface positioned at the right surface.

Herein, when the first rotation means 130*a* rotates, a sixth surface opposite to the first surface does not change in color.

As the first rotation means 130*a* rotates by 90 degrees as above, 1×N cells of the second surface to the fifth surface which are adjacent to the first surface change in light moving by 90 degrees in a direction identical to the rotation direction of the first rotation means 130*a*, that is, the 1×N cells of each surface changes in light as moving by one surface. This means that, whenever each rotation means rotates with an angle of an integer multiple of 90 degrees, corresponding color changes occur.

Figure 6:
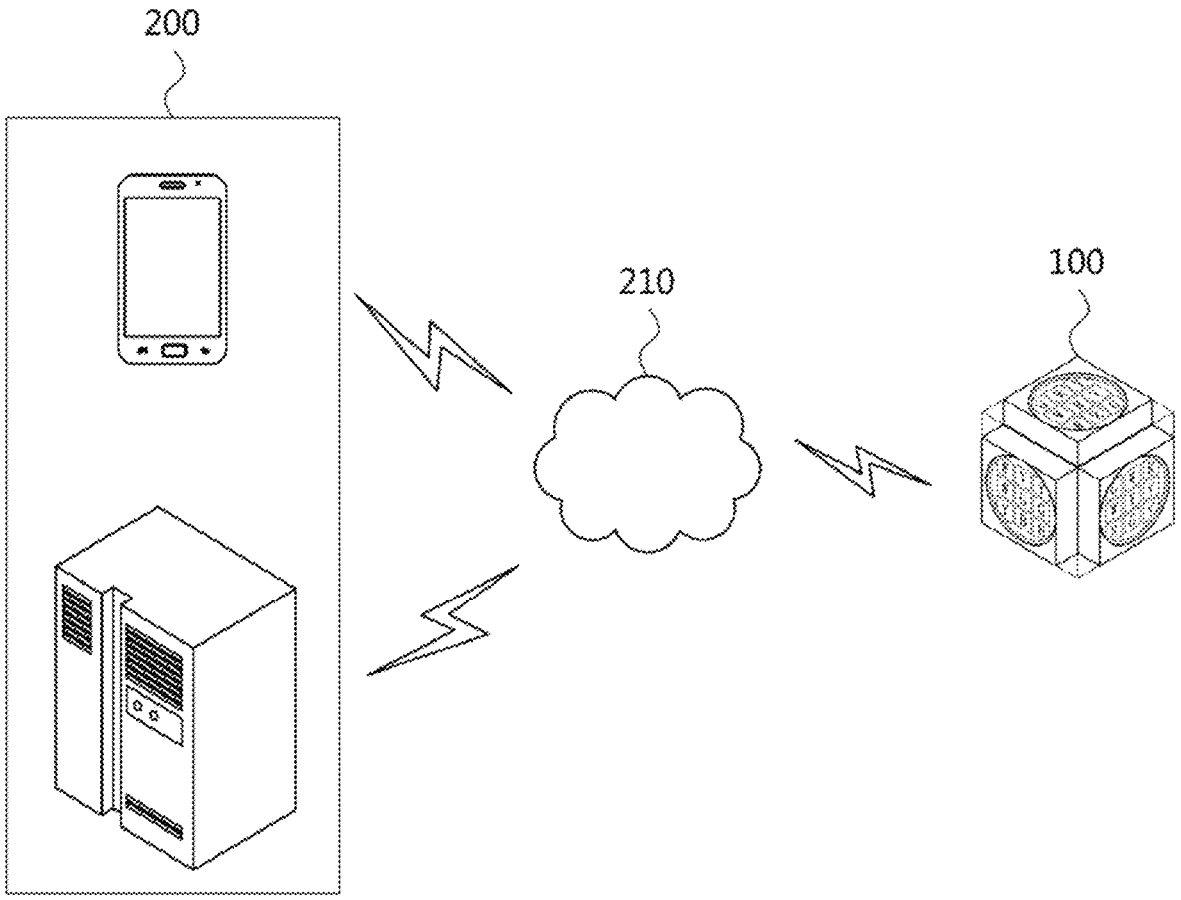
FIG. 6 is a view showing an example of performing communication between the smart magic cube according to an embodiment of the present invention and an external device.

FIG. 6 is a view showing an example of performing communication between the smart magic cube according to an embodiment of the present invention and an external device.

Referring to FIG. 6, the smart magic cube 100 according to an embodiment of the present invention may perform data communication with various external devices 200 by using a wired/wireless communication network 210. For this, the smart magic cube 100 includes a communication module (not shown) therein for performing wired/wireless communication.

A communication method using the wired/wireless communication network 210 may be variably set. For example, data communication using a cable, communication wired/wireless Internet network, near field communication such as WiFi, Bluetooth, Zigbee, etc. may be used.

The external device 200 may be implemented in various forms, for example, mobile terminals, smart-phones, tablet devices, note-PC, desktop computers, server computers, etc. The external device 200 may provide various services and management which are related to the smart magic cube 100.

In the above configuration, the smart magic cube 100 may perform communication with the external device 200, and transmit and receive various types of information and data. For example, the external device 200 may store various cube game patterns, and the smart magic cube 100 may download the cube game patterns therefrom. The smart magic cube 100 stores various cube game patterns downloaded from the external device 200 in the internal memory, and provides a cube game pattern according to a specific signal by mixing lights according to the cube game pattern.

In addition, various records and information which are stored in the smart magic cube 100 may be transmitted to the external device 200. For example, a cube game record of the user may be transmitted to the external device 200.

In addition, in the present invention, communication between external devices 200 is also available. For example, communication between a smart-phone and a server computer is available. The smart-phone may receive a cube game record from the smart magic cube 100, and upload the record in a server computer by accessing the server by using the Internet. Alternatively, various services or programs for the smart magic cube 100 may be downloaded from the server computer and transmitted to the smart magic cube 100.

In addition, the server computer may receive and manage respective records from smart-phones of various users, register and manage a record rank between users, and provide various event services such as managing an online cube game contest, etc.

Figure 7A:
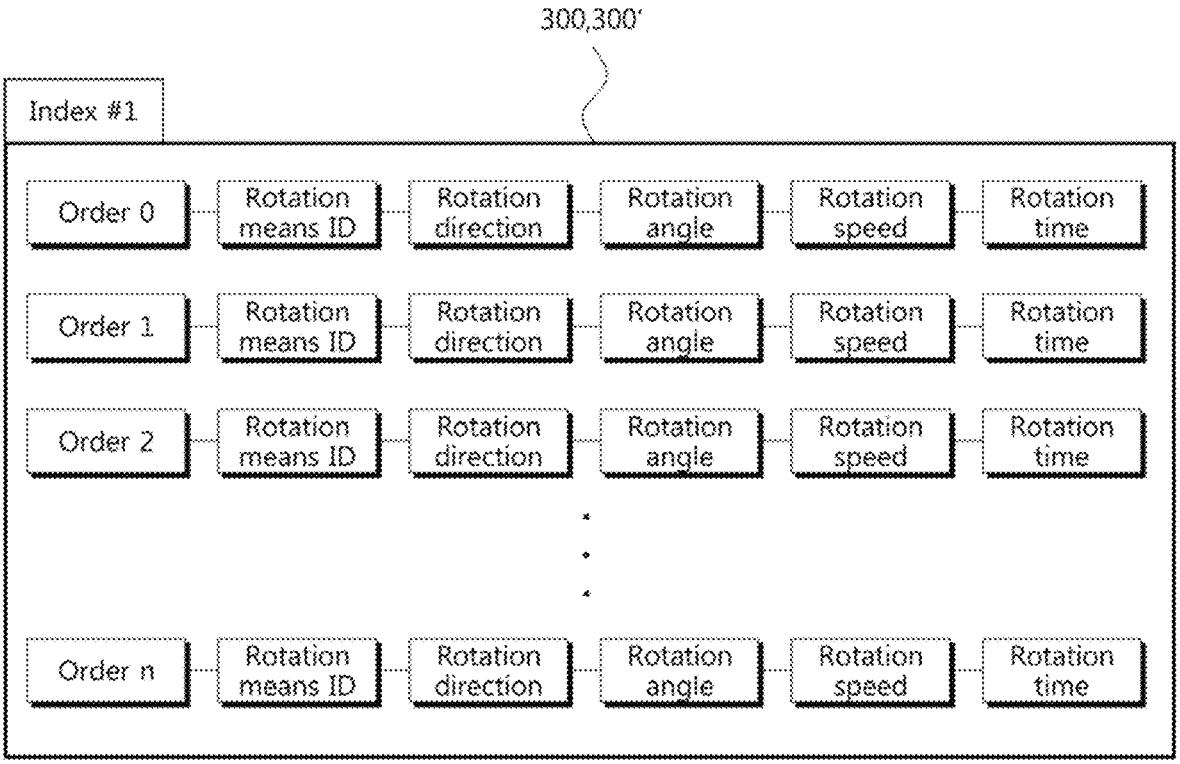
FIGS. 7A and 7B are views showing an example of rotation information of a rotation means and a cube game pattern which are applied to the smart magic cube according to an embodiment of the present invention.
Figure 7B:
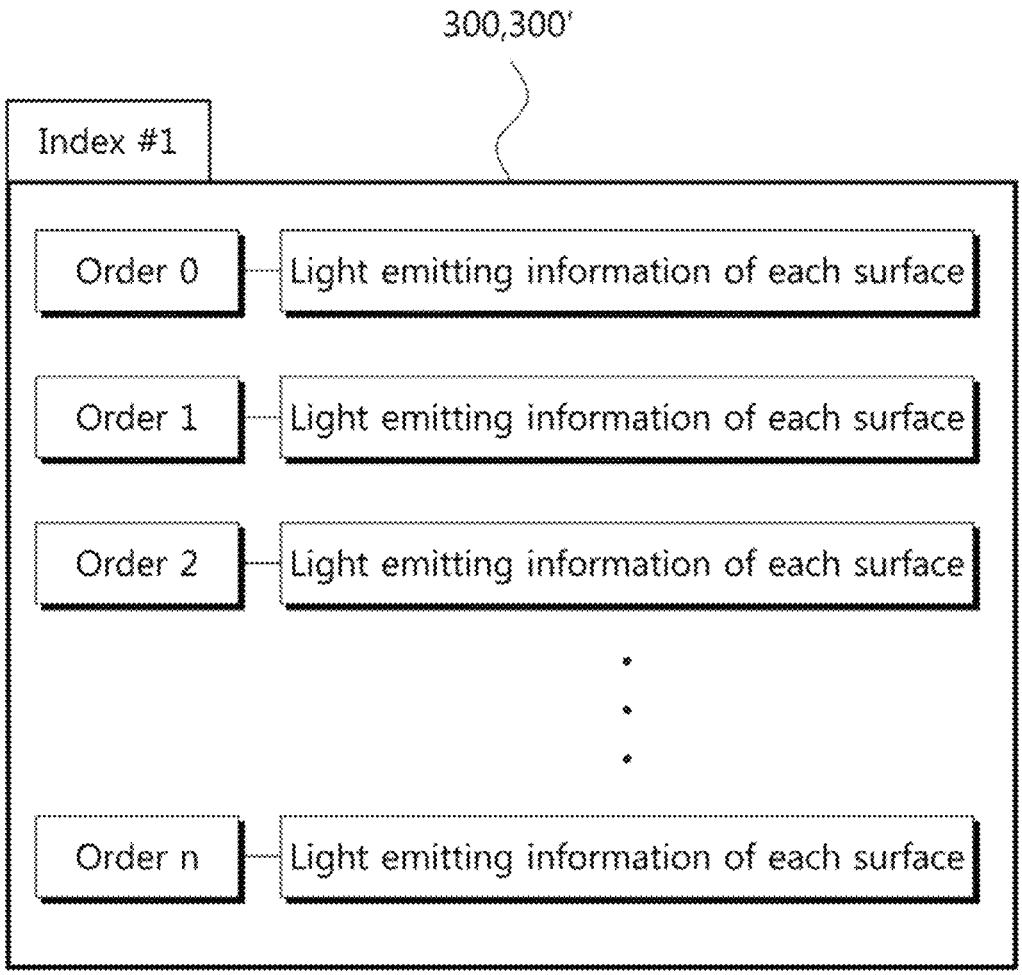

FIGS. 7A and 7B are views showing an example of rotation information of the rotation means and a cube game pattern which are applied to the smart magic cube according to an embodiment of the present invention.

Referring to FIG. 7A showing an example of rotation information 300 of the rotation means 130 and a cube game pattern 300', in the smart magic cube 100 of the present invention, the control part 150 stores in the internal memory rotation information 300 including an identifier (ID), a rotation direction, a rotation angle, a rotation speed, a rotation time, etc. of the rotation means 130 according to the rotation of the rotation means 130.

In addition, the smart magic cube 100 may pre-store a cube game pattern 300' in the internal memory. The cube game pattern 300' may be directly generated by the user and stored in the internal memory, or may be stored by being downloaded from the external device 200.

The rotation information 300 and the cube game pattern 300' may have the same configuration as shown in FIGS. 7A and 7B. Of course, the rotation information 300 and the cube game pattern 300' may be configured with other types of information.

As the example shown in FIG. 7A, rotation information 300 is stored in a rotating sequence of the rotation means. Herein, the rotation information 300 is sequentially stored starting from when a cube game is started until the cube game is completed, and an index may be assigned to various pieces of rotation information 300 from the starting to the completion of the cube game by grouping the same in one set, and stored. For example, when it is assumed that the rotation means has rotated 50 times starting from when a cube game is started until the cube game is completed, each piece of rotation information 300 corresponding to 50 times of rotation is set to one set, and an index is assigned to each set. Each index may include information of a time when each index is assigned.

In the figure, an order represents a rotation order of the rotation means 130, a rotation means ID is for identifying which rotation means among six rotation means has rotated, and a rotation angle and a rotation direction respectively mean an angle and a direction of the rotation means 130 when each rotation means 130 rotates. In addition, a rotation time means an average time required when the rotation means 130 rotates by the rotation angle in association with the rotation angle, and a rotation speed means an average speed represented in a level when each rotation means 130 rotates by the rotation angle.

In addition, rotation information 300 shown in FIG. 7A may be used as a cube game pattern 300'. The cube game pattern 300' is information for providing a cube game in the smart magic cube 100, and rotation information of an identifier (ID), a rotation angle, a rotation direction, a rotation speed, a rotation time, etc. of the rotation means 130 is sequentially preset. In other words, the cube game pattern 300' may include contents in which pieces of rotation information for six surfaces are sequentially created. Accordingly, when a cube game is completed, and the rotation means 130 is rotated according to an order of the rotation information set in the cube game pattern 300', or a color of each surface is adjusted according to the order of the rotation information without rotating the rotation means 130, a cube game according to the cube game pattern 300' may be provided. As shown in FIGS. 7A and 7B, various pieces of information which are sequentially set are set as one set of a cube game pattern 300', and the above cube game pattern 300' may be implemented in various patterns different from each other.

The cube game pattern 300' may be pre-stored in the internal memory of the smart magic cube 100, or may be stored in the memory by being downloaded from various external devices 200 through communication. Then, when a cube game mode is selected in the smart magic cube 100, a cube game is provided by mixing colors according to an order set in the cube game pattern 300' stored in the internal memory.

The cube game mode may be implemented in various methods. A game may be provided by using various methods such as inputting vibration by shaking the smart magic cube 100 for a predetermined time or more, inputting a first signal by using a smart-phone through wireless communication, setting a preset internal operation mode in the smart magic cube 100, etc.

Particularly, in the present invention, when the smart magic cube 100 downloads a file including a cube game pattern 300' from a memory of an external device by using wired or wireless communication in the system of FIG. 6 and executes a cube game mode, a cube game is provided by mixing colors of each surface by sequentially analyzing the cube game pattern 300'. Herein, when providing a cube game as above, cell colors may be changed by rotating the rotation means, or cell colors may be changed while the rotation means is in a fixed state.

Meanwhile, as another example shown in FIG. 7B, the above rotation information 300 and the cube game pattern 300' may include light emitting information of cells 101 of each surface according to a rotation order of the rotation means 130. Herein, the light emitting information means light information emitted from the light emitting part 120 in each cell 101. In other words, the light emitting information means information of colors, letters, symbols, figures, commercial characters displayed on each cell by using the emitted light. Accordingly, the light emitting information of light output from each cell according to the rotation of the rotation means 130 may be set as rotation information 300 by storing the rotation of the rotation means 130 according to a rotation order (turn), or a cube game pattern 300' may be set by storing light emitting information of cells of each surface according to an order.

In FIGS. 7A and 7B, for example, rotation information 300 and a cube game pattern 300' are respectively shown. However, in another example, various types of rotation information 300 and a cube game pattern 300' may be set.

Figure 8:
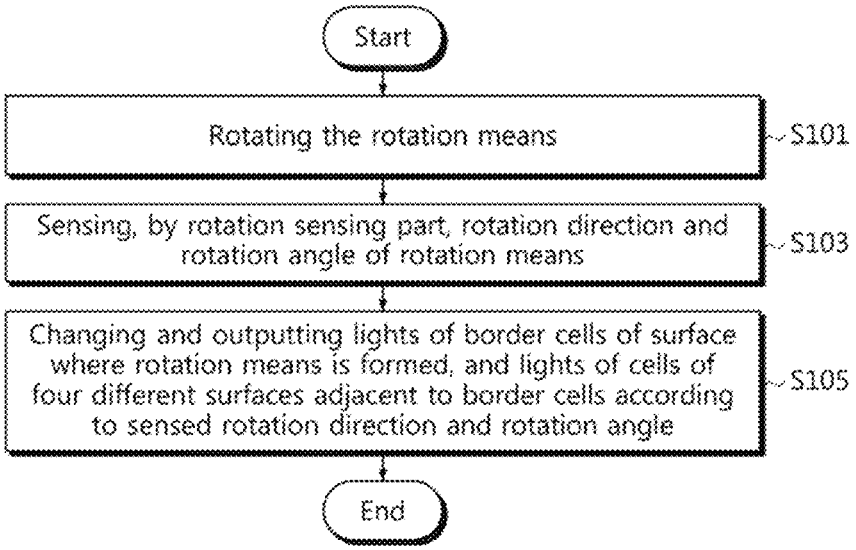
FIG. 8 is a view showing a flowchart of a method of operating the smart magic cube according to an embodiment of the present invention.

FIG. 8 is a view showing a flowchart of a method of operating the smart magic cube according to an embodiment of the present invention.

FIG. 8 a view showing a flowchart of a method of operating the smart magic cube 100 shown in FIGS. 1 to 7 according to an embodiment of the present invention. First, when the rotation means 130 formed in each surface of a cube housing 110 rotates in step S101, in step S103, the rotation sensing part 140 senses rotation information including a rotation direction and a rotation angle of the rotation means 130, an identifier (ID), a rotation speed, a rotation time, etc. of the rotation means 130.

Then, in step S105, in response to the rotation direction and the rotation angle of the rotation means 130 which are sensed by the rotation sensing part 140 as above, the light emitting part 120 changes and emits lights of cells of four different surfaces adjacent to border cells of a surface where the rotated rotation means 130 is formed according to a preset rule.

The preset rule is to move lights, as shown in FIG. 5, of cells positioned at upper, low, left right borders among N×N cells formed in the first surface, and of 1×N cells of second to fifth surfaces adjacent to the border cells in a rotation direction identical to the first rotation means 130*a* by the integer multiple.

Whenever a rotation angle of the rotation means 130 becomes 90 degrees, colors of the 1×N cells are shifted in the rotation direction of the rotation means 130 by one surface, and whenever a rotation angle of the rotation means 130 becomes an angle of an integer multiple of 90 degrees, colors of the 1×N cells are shifted in the rotation direction of the rotation means by the integer multiple. The color movement means that each cell changes in light while the cell is fixed.

Herein, in steps S103 and S105, the control part 126 sequentially stores rotation information including a rotation direction, a rotation angle, an identifier (ID), a rotation speed, a rotation time, etc. of the rotation means 130, and information of changes in cell color of each surface in the internal memory whenever the rotation means 130 rotates. The order means a rotation order of the rotation means 130.

In addition, after step S103 or S105, when a specific signal is received from an external device 200 such as mobile terminal or server, or when vibration is sensed by the internal vibration sensing part 170 for a preset time or more, a step of mixing and changing cells colors of each surface to any one color pattern among a plurality of preset color patterns may be further included. Accordingly, a cube game may be provided by changing cell lights of the smart magic cube 100 to one pattern among preset patterns when a first signal for changing the cell color is received from the external device, when a preset internal operation mode command is received, or when vibration of the smart magic cube 100 is sensed for a preset time or more. The first signal includes, for example, a command through which a cube pattern is provided by the smart-phone through wireless communication, and the internal operation mode command includes a command through which a cube game is provided by the smart magic cube 100 itself.

For this, a plurality of color pattern games is stored in the internal memory, cell colors are changed to any one game pattern that is randomly selected from the plurality of color pattern games by a predetermined signal or behavior. Accordingly, the smart magic cube 100 may automatically provide a cube game by combining cell lights rather than the user changes cell lights when he or she wants to play a game.

In addition, in the present invention, in step S105, in response to the rotation means 130 having continuously rotated at least one time, the control part 150 stores the rotation information of the rotation means 130 sensed by the rotation sensing part 140 in the internal memory according to a rotation order. Accordingly, a playing order of the cube game, by the user, is stored. In addition, it may be used for a return mode and a replay mode for the cube game.

In other words, in the present invention, among a plurality of preset modes, when a return mode is selected, for example, the control part 150 sequentially changes cells colors of each surface according to an inverse order of the rotation order of the rotation means 130 by using the rotation information including the identifier (ID), the rotation direction, the rotation angle, the rotation time, the rotation speed, etc. of the rotation means 130 which is stored in the internal memory. In addition, when a return mode selected, in another example, the control part 150 sequentially changes cell colors of each surface according to a light emitting order in which light is changed and emitted for each cell 101 by using light information of each cell 101 stored in the internal memory.

Herein, in the former example, a return mode is executed by sequentially changing cell lights of each surface while the rotation means 130 rotates, and in the later example, a return mode is executed by sequentially changing cell lights of each surface while the rotation means 130 does not rotate.

By using the return mode, when the user selects to store an order of a cube game and selects a return mode, how the user has played the cube game may be checked by changing cell lights in an inverse order from the order that the user has played the cube game.

In addition, in the present invention, among a plurality of presets modes, for example, when a replay mode is selected, the control part 150 sequentially changes cell colors of each surface according to the rotation order of the rotation means 130 by using the rotation information of the rotation means 130 which is stored in the internal memory. In addition, when a replay mode is selected, in another example, the control part 150 sequentially changes cell colors of each surface according to a light emitting order in which light is changed and emitted for each cell 101 by using light information of each cell 101 stored in the internal memory.

Herein, in the former example, a replay mode is executed by sequentially changing cell lights of each surface while the rotation means 130 rotates, and in the later example, a replay mode is executed by sequentially changing cell lights of each surface while the rotation means 130 does not rotate.

By using the replay mode, when the user selects to store an order of a cube game and selects a replay mode, how the user has played the cube game may be checked by changing cell colors in an order that the user has played the cube game. In the replay mode, cells 101 may sequentially change in color for each surface, or the rotation means 130 actually rotates by using the motor 190 and cells 101 may change in color in association with the rotation. In other words, the control part 150 operates the motor 190 according to the rotation information stored in the internal memory to rotate the corresponding rotation means 130 so that the rotation means 130 actually rotates and each cell 101 changes in color for each surface in association with the rotation.

The replay mode may be used for replaying the cube game played by the user, and for replaying a cube gamed played by another user. In addition, when replaying a cube gamed played by another user, in the present invention, when various users respectively play his or her cube game and upload rotation information stored in the internal memory to the external device 200, a replay mode may be replayed by another user by accessing the external device 200, downloading the rotation information his or her smart magic cube, and executing the same. Of course, the rotation information may be stored in a portable memory such as USB, etc., and may be copied or stored in another smart magic cube FIG. 9 is a view showing a flowchart of a method of operating the smart magic cube according to an embodiment of the present invention.

Figure 9:
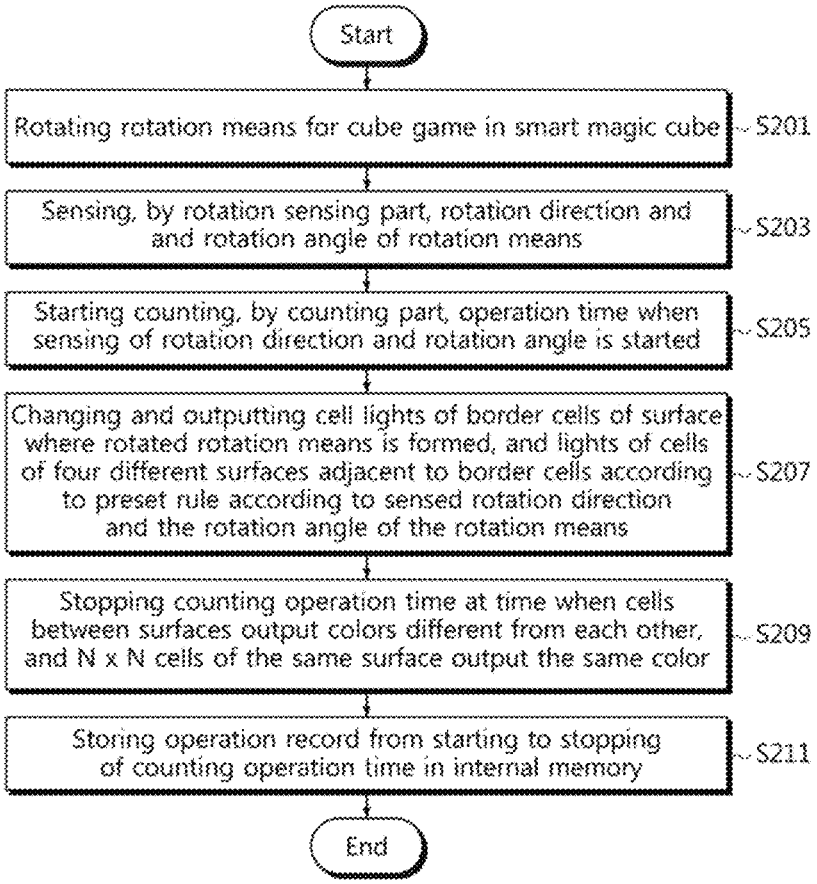
FIG. 9 is a view showing a flowchart of a method of operating the smart magic cube according to another embodiment of the present invention.

Referring to FIG. 9, in the cube smart magic cube 100 according to the present invention, in step S201, the rotation means 130 rotates during a cube game, and in step S203, the rotation sensing part 140 starts sensing a rotation direction and a rotation angle of the rotation means 130. In step S205, the counting part 180 starts counting an elapsing time when the rotation sensing part 140 starts sensing.

In succession, in response to the rotation direction and the rotation angle of the rotation means 130 which are sensed by the rotation sensing part 140, in step S207, the light emitting part 120 changes cells of four different surfaces adjacent to border cells of a surface where the rotated rotation means 130 is formed in color according to a preset rule.

As the rotation means 130 continuously rotates, cells between each surface change in color, in step S209, at a time when cells between surfaces output colors different from each other, and N×N cells 101 of the same surface output the same color, that is, when the cube game is completed, the counting part 180 stops counting the elapsing time.

Then, in step S211, an operation record from the starting to the end of the elapsing time counted as above is stored in the internal memory.

Additionally, after step S211, the stored operation record is displayed on at least one surface among six surfaces by adjusting cell colors. Accordingly, the user may visually externally check the time taken for playing the cube game. Of course, in another embodiment, the operation record may be output by voice.

After step S209, the communication part may transmit the stored operation record to the external device 200. In addition, in S207, whenever a rotation angle of the rotation means 130 becomes 90 degrees, the above 1×N cells changes in color from current colors in the rotation direction of the rotation means 130 to cause the same effect as the cells moves by one surface.

Figure 10:
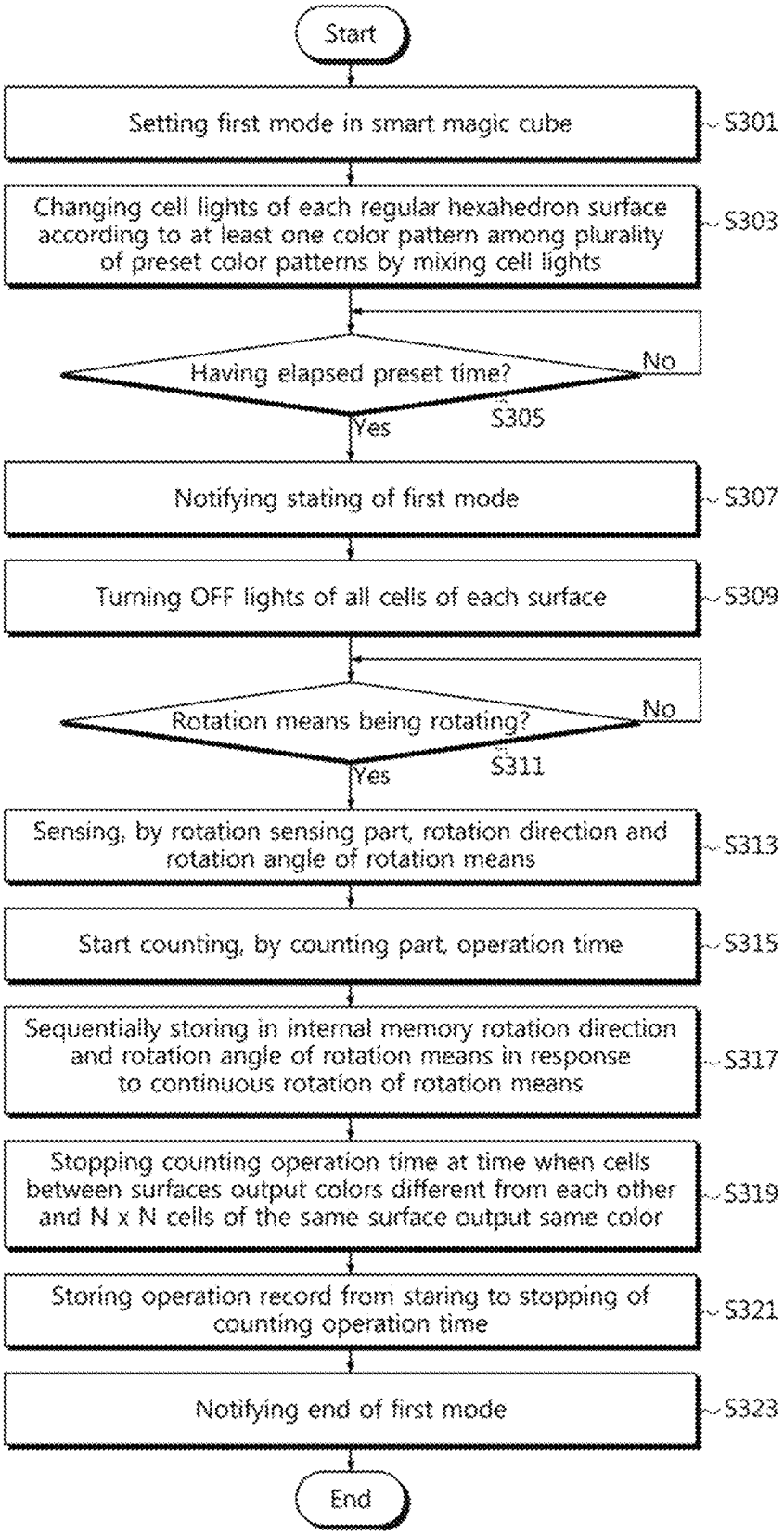
FIG. 10 is a view showing a flowchart of a method of operating the smart magic cube according to another embodiment of the present invention.

FIG. 10 is a view showing a flowchart of a method of operating the smart magic cube according to another embodiment of the present invention.

Referring to FIG. 10, in step S301, a first mode is set in the smart magic cube 100, and in step S303, cells 101 of each cube surface change in color according to at least one color pattern among a plurality of preset color patterns so that cell lights are mixed. Herein, the first mode is a mode among a plurality of preset modes, and may be a coding mode for providing, for example, a cube game. The plurality of modes may be set as a return mode, a replay mode, a cube game mode, a color mixing mode, a cube automatically playing mode, a coding mode, etc. Herein, the coding mode is a mode providing a kind of cube game, which refers to a cube game against the clock wherein a user plays the cube game using only his or her memory while all cells are turned OFF by the light emitting part after being provided with the cube game from the smart magic cube.

For this, after step S303, when a preset time elapses in step S305, in step S307, starting of the first mode is notified. Notifying starting of the first mode may be performed by outputting a specific sound, a specific color, etc.

In step S309, all cells of each surface are turned OFF when the first mode is started. The cells may be turned OFF by blocking power provided to the light emitting part 120. Herein, it is preferable to store respective cell colors in the internal memory just before turning OFF the emission of lights of all cells.

In succession, after step S309, in step S311, the rotation means 130 rotates as the cube game has started, and in step S313, the rotation sensing part 140 starts sensing a rotation direction and a rotation angle of the rotation means 130. In step S315, the counting part 180 starts counting an operation time when the rotation sensing part 140 starts sensing.

Then, in response to continuous rotating of the rotation means, in step S317, the rotation direction and the rotation angle of the rotation means 130 sensed by the rotation sensing part 140 are sequentially stored in the internal memory.

By the rotation direction and the rotation angle of the rotation means 130 which is sequentially stored in the internal memory as above, in step S319, at a time when cells between surfaces output colors different from each other, and N×N cells 101 of the same surface output the same color, counting of the operation time is stopped. In other words, step S319 is to stop counting the operation time when the cube game is completed.

In succession, in step S321, an operation record from the starting to stopping counting of the operation time is stored in the internal memory, and in step S323, end of the first mode is notified.

A process of the coding mode is completed as above.

Herein, after step S323, cell colors of at least one surface among six surfaces of the operation record stored in the internal memory may be selectively changed and output. Accordingly, the operations record may be visually provided. Of course, in other embodiments, the operations record may be acoustically provided by outputting the same by voice.

In addition, after step S321, the communication part may transmit the operation record stored in the internal memory to the external device. Herein, the external device may receive an operation record transmitted from various smart magic cubes, and store and manage the same. Accordingly, the external device may provide services such as providing a rank using various game records among various users through the Internet. Accordingly, users may check his or her game record and game records of other users which stimulate competition. Accordingly, motivations, such as making more efforts to increase his or her ranking or to shorten the record of cube game may be provided.

Even though all of elements of the exemplary embodiments according to the present invention have been described as being coupled or as being coupled and operating as one element, the present invention is not limited to the exemplary embodiments. That is, to the extent of the purpose of the present invention, all of such elements may be selectively coupled and operate as one or more elements. Terms such as "include", "form", or "have" as described above mean that a concerned element may be inherent in the concerned element unless there is any statement specifically to the contrary. In this regard, such terms should be interpreted that the elements may further include other elements instead of excluding other elements. All terms including technical or scientific terms have the same meaning as generally understood by the person having the typical knowledge in the technical field to which the present invention belongs unless otherwise defined. Terms which are generally used as terms defined in a dictionary should be interpreted as being consistent with the meaning in context of the relevant technology and will not be interpreted as idealistic or excessively formal meaning.

Although a few exemplary embodiments have been shown and described, it will be appreciated by those skilled in the art that changes may be made in these exemplary embodiments without departing from the principles and spirit of the invention, the range of which is defined in the appended claims and their equivalents. Accordingly, the exemplary embodiments of the present invention are provided to explain the technical spirit of the present invention but not to limit such spirit. The scope of the technical spirit of the present invention is not limited by the exemplary embodiments of the present invention. The scope of protection of the present invention should be interpreted by the claims below, and all technical spirits which are in the same scope would be interpreted as being included in the scope of right of the present invention.

What is claimed is:

1. A smart magic cube, the magic cube comprising:

a cube housing in which each surface is divided by N×N cells;

a plurality of light emitting parts formed inside each cell and emitting at least one type of light externally through a surface of the cell;

six motors installed inside of each surface;

six rotation means formed in a rotatable manner based on a rotation shaft passing through a center of each surface;

six rotation sensing parts sensing a rotation direction and a rotation angle according to a rotation of each of the six rotation means; and a control part controlling the light emitting parts to change and emit lights such that border cells of a surface where the rotated rotation means is formed, and cells of four different surfaces adjacent to the border cells output lights changed according to a preset rule in response to the rotation direction and the rotation angle of the rotation means sensed by the rotation sensing part, wherein each light emitting part includes LED devices of red (R), green (G) and blue (B) colors and emits light of at least 6 different colors by combining the LED devices, and wherein a rotation shaft of each of the motors is coupled with the rotation shaft of the rotation means to be associated with each other, and a rotation of the rotation shaft of each of the rotation means is are controlled according to a rotation of the rotation shaft of each of the motors.

2. The smart magic cube of claim 1, wherein, among N×N cells of the respective four different surfaces, 1×N cells adjacent to the border cells output lights moving in the rotation direction and the rotation angle of the rotation means by one surface in response to the rotation direction and the rotation angle of the rotated rotation means.

3. The smart magic cube of claim 2, wherein the 1×N cells output lights moving with current lights in the rotation direction of the rotation means whenever the rotation angle of the rotation means becomes 90 degrees.

4. The smart magic cube of claim 1, wherein whenever a rotation angle of the rotation means sensed by the rotation sensing part becomes an integer multiple of 90 degrees, the motor stops the rotation of the rotation means by rotating the rotation shaft of the rotation means in a direction opposite to the rotation direction of the rotation means.

5. The smart magic cube of claim 1, further comprising a power part turning ON/FF the smart magic cube, and when the smart magic cube enters an ON state from an OFF state by power of the power part, cells between surfaces of the cube housing output colors different from each other, and all cells of the same surface output the same color.

6. The smart magic cube of claim 1, further comprising a vibration sensing part sensing vibration of the cube housing, and when vibration is sensed by the vibration sensing part for a preset time or more, the control part changes cell lights according to any one pattern among a plurality of cube game patterns by mixing the cell lights.

7. The smart magic cube of claim 1, wherein the rotation sensing part further senses, in addition to the rotation direction and the rotation angle of the rotation means, rotation information of the rotation means such as an identifier (ID), a rotation speed, a rotation time, etc., and the control part stores in an internal memory in a sensed order the rotation information sensed by the rotation sensing part in response to at least one continuous rotation of the rotation means.

8. The smart magic cube of claim 1, further comprising a counting part counting an elapsed time from an initial rotation time of the rotation means to a completion time when cells between surfaces output colors different from each other, and all cells of the same surface output the same color.

9. The smart magic cube of claim 8, wherein the control part stores in an internal memory the elapsed time counted by the counting part with the completion time.

10. The smart magic cube of claim 1, wherein when the rotation sensing part senses the rotation of the rotation means, the control part operates the motor to rotate the rotation shaft of the motor in a rotation direction of the rotation means, so that the rotation means rotates, and when the rotation angle of the rotation means becomes 90 degrees, the control part stops the operation of the motor.

11. A smart magic cube, the magic cube comprising:

a body part formed having an internal space at a center thereof, and six through holes formed to a direction of each surface of a cube at the internal space thereof;

N×N cells coupled with respective through holes at an end part thereof;

six motors installed in each through hole;

a plurality of light emitting parts formed inside of each cell, and emitting various types of lights externally through a surface of each cell;

six rotation means formed in a rotatable manner by being coupled with a rotation shaft passing through a center of each surface;

six rotation sensing part formed in each through hole, and sensing a rotation direction and a rotation angle according to the rotation of each of the six rotation means; and a control part controlling the light emitting parts to change and emit lights such that border cells of a surface where the rotated rotation means is formed, and cells of four different surfaces adjacent to the border cells output lights changed according to a preset rule in response to the rotation direction and the rotation angle of the rotation means sensed by the rotation sensing part, wherein a rotation shaft of each of the motors is coupled with the rotation shaft of the rotation means to be associated with each other, and a rotation of the rotation shaft of each of the rotation means is are controlled according to a rotation of the rotation shaft of each of the motors.

12. The smart magic cube of claim 11, wherein, among N×N cells of the respective four different surfaces, 1×N cells adjacent to the border cells output colors moving in the rotation direction and the rotation angle of the rotation means by one surface in response to the rotation direction and the rotation angle of the rotated rotation means.

13. The smart magic cube of claim 11, wherein the 1×N cells output lights with current colors moving in the rotation direction of the rotation means whenever the rotation angle of the rotation means sensed by the rotation sensing part becomes 90 degrees.

14. The smart magic cube of claim 11, wherein each cell displays a plurality of preset colors, letters, figures, symbols, and commercial characters by using light emitted from the light emitting part.

15. The smart magic cube of claim 11, further comprising a power part turning ON/FF the smart magic cube, and when the smart magic cube enters an ON state from an OFF state by power of the power part, cells between surfaces of the cube output colors different from each other, and all cells of the same surface output the same color.

16. The smart magic cube of claim 11, further comprising a counting part counting an elapsed time from an initial rotation time of the rotation means to a completion time when cells between surfaces output colors different from each other, and N×N cells of the same surface output the same color.

17. The smart magic cube of claim 11, wherein whenever a rotation angle of the rotation means sensed by the rotation sensing part becomes an integer multiple of 90 degrees, the motor stops the rotation of the rotation means by rotating the rotation shaft of the rotation means in a direction opposite to the rotation direction of the rotation means.

18. The smart magic cube of claim 11, wherein when the rotation sensing part senses the rotation of the rotation means, the control part operates the motor to rotate the rotation shaft of the motor in a rotation direction of the rotation means, so that the rotation means rotates, and when the rotation angle of the rotation means becomes 90 degrees, the control part stops the operation of the motor.

19. The smart magic cube of claim 11, wherein the rotation shaft of the motor and the rotation shaft of the rotation means are arranged to be parallel to each other so that to be coupled and associated with each other by using at least one gear part.

20. A method of operating a smart magic cube, wherein the method operates the smart magic cube of claim 11, the method comprising:

sensing, by a rotation sensing part, a rotation direction and a rotation angle of a rotation means; and changing and outputting lights of border cells of a surface where a rotated rotation means is formed, and lights of cells colors of cells of four different surfaces adjacent to the border cells changed according to a preset rule in response to the rotation direction and the rotation angle of the rotation means are sensed by the rotation sensing part.

21. The method of claim 20, wherein, among N×N cells of the respective four different surfaces, 1×N cells adjacent to the border cells output lights moving in the rotation direction and the rotation angle of the rotation means by one surface in response to the rotation direction and the rotation angle of the rotated rotation means.

22. The method of claim 21, wherein the 1×N cells output lights with current colors moving in the rotation direction of the rotation means whenever the rotation angle of the rotation means becomes 90 degrees.

23. The method of claim 20, wherein the changing of the lights includes storing in an internal memory light emitting information of light output from each cell of each surface whenever lights of cells in each surface are changed and emitted.

24. The method of claim 20, further comprising: before the sensing of the rotation direction and the rotation angle or after the changing and outputting of the lights, when a first signal is received from an external device or vibration is sensed for a preset time or more by an internal vibration sensing part, changing and outputting cell lights of each surface to any one color pattern among a plurality of preset color patterns by mixing the cell lights.

25. The method of claim 20, wherein when the rotation means rotates, the rotation sensing part further senses rotation information including an identifier (ID), a rotation speed, and a rotation time of the rotation means, and the control part stores in an internal memory in a sensed order the rotation information sensed by the rotation sensing part in response to at least one continuous rotation of the rotation means.

26. The method of claim 25, wherein when a return mode is selected among preset modes, the control part changes cell lights of each surface according to an order that is an order inverse to the rotation information stored in the internal memory.

27. The method of claim 25, wherein when a return mode is selected among preset modes, the control part changes cell lights of each surface by rotating the rotation means according to an order that is an order inverse to the rotation information stored in the internal memory.

28. The method of claim 25, wherein when a replay mode is selected among preset modes, the control part changes cell lights of each surface according to an order of the rotation information stored in the internal memory.

29. The method of claim 25, wherein when a replay mode is selected among preset modes, the control part changes cell lights of each surface by rotating the rotation means according to an order of the rotation information stored in the internal memory.

30. The method of claim 20, wherein each cell displays a plurality of preset colors, letters, figures, symbols, and commercial characters by using light emitted from the light emitting part.

31. A method of operating a smart magic cube, wherein the method operates the smart magic cube of claim 11, the method comprising:

starting counting, by a counting part, an operation time when a rotation sensing part starts sensing a rotation direction and a rotation angle;

changing and outputting lights of border cells of a surface where the rotated rotation means is formed, and lights of cells of four different surfaces adjacent to the border cells changed according to a preset rule in response to the rotation direction and the rotation angle of the rotation means sensed by the rotation sensing part;

stopping counting the operation time at a time when cells between surfaces output lights different from each other, and N×N cells of the same surface output the same lights according to the rotation of the rotation means; and storing an operation record from the starting to the stopping of counting the operation time in an internal memory.

32. The method of claim 31, further comprising, after the storing of the operation record, displaying the stored operation record on at least one surface of six surfaces by changing cell lights.

33. The method of claim 31, further comprising, after the storing of the operation record, transmitting, by a communication part, the stored operation record to an external device.

34. The method of claim 31, wherein in the changing and outputting of the lights, 1×N cells outputs lights moving with current colors in the rotation direction of the rotation means whenever the rotation angle of the rotation means becomes 90 degrees.

35. The method of claim 31, wherein each cell displays a plurality of preset colors, letters, figures, symbols, and commercial characters by using light emitted from the light emitting part.

36. The method of claim 31, wherein in the storing of the operation record, rotation information including an identifier (ID), a rotation speed, and a rotation time of the rotation means rotating from the starting to stopping of counting the operation time, or light emitting information of each cell of each surface is additionally sequentially stored in the internal memory.

37. A method of operating a smart magic cube, wherein the method operates the smart magic cube of claim 11, the method comprising:

when a first mode is set, changing cell lights of each surface of a cube according to at least one color pattern among a plurality of preset color patterns by mixing the cell lights;

notifying stating of the first mode when a preset time elapses after setting the first mode;

turning OFF lights of all cells of each surface when the first mode is started;

start counting, by a counting part, an operation time when a rotation sensing part starts sensing a rotation direction and a rotation angle of a rotation means after turning OFF the lights;

sequentially storing in an internal memory the rotation direction and the rotation angle of the rotation means sensed by the rotation sensing part in response to the rotation of the rotation means;

stopping counting the operation time at a time when cells between surfaces output colors different from each other, and N×N cells of the same surface output the same color by the rotation direction and the rotation angle sequentially stored in the internal memory;

storing an operation record from staring to stopping of counting the operation time; and notifying an end of the first mode.

38. The method of claim 37, further comprising, after the notifying of the end of the first mode, displaying the stored operation record on at least one surface of six surfaces by changing the cell lights.

39. The method of claim 37, further comprising, after storing the operation record, transmitting, by a communication part, the stored operation record to an external device.

40. The method of claim 37, wherein each cell displays a plurality of preset colors, letters, figures, symbols, and commercial characters by using light emitted from the light emitting part.

41. The method of claim 37, wherein in the storing of the rotation direction and the rotation angle, in addition to the rotation direction and the rotation angle of the rotation means sensed by a rotation sensing part, rotation information including an identifier (ID), a rotation speed, and a rotation time of the rotation means rotating from the starting to stopping of counting the operation time, or light emitting information of each cell of each surface is additionally sequentially stored in the internal memory.

* * * * *